US005212341A

United States Patent [19]

Osborne et al.

[11] Patent Number: 5,212,341

[45] Date of Patent: May 18, 1993

[54] CO-EXTRUDED SHOCK TUBE

[76] Inventors: Alfred M. Osborne, 16816 S. 1400 West, Bluffdale, Utah 84065; Patrick J. Harder, Rd. 7, Box B, Kingston, N.Y. 12401

[21] Appl. No.: 882,377

[22] Filed: May 6, 1992

Related U.S. Application Data

[63] Continuation of Ser. No. 745,385, Aug. 15, 1991, abandoned.

[51] Int. Cl.[5] ..... C06C 5/04

[52] U.S. Cl. ..... 102/275.8; 86/22

[58] Field of Search ..... 102/275.8, 275.5, 275.6, 102/275.9, 275.11, 304, 275.1; 86/22, 1.1, 31

[56] References Cited

U.S. PATENT DOCUMENTS

| | | | |
|---|---|---|---|
| 2,993,236 | 7/1961 | Brimley et al. | 86/1.1 |
| 3,590,739 | 7/1971 | Persson | 102/275.5 |
| 3,726,216 | 4/1973 | Calder, Jr. et al. | 102/275.8 |
| 3,730,096 | 5/1973 | Prior | 102/275.8 |
| 4,177,732 | 12/1979 | Steele | 86/1.1 |
| 4,328,753 | 5/1982 | Kristensen et al. | 102/275.5 |
| 4,369,688 | 1/1983 | Yunan | 102/275.8 |
| 4,493,261 | 1/1985 | Simon et al. | 102/275.8 |
| 4,607,573 | 8/1986 | Thureson et al. | 102/275.8 |
| 4,699,059 | 10/1987 | Kelly et al. | 102/275.7 |
| 4,757,764 | 7/1988 | Thurson et al. | 102/275.8 |
| 5,001,981 | 3/1991 | Shaw | 102/275.8 |

FOREIGN PATENT DOCUMENTS

| | | | |
|---|---|---|---|
| 958941 | 3/1950 | France | 86/1.1 |
| 1189939 | 4/1970 | United Kingdom | 86/22 |

*Primary Examiner*—Stephen M. Johnson

[57] ABSTRACT

The invention relates to a method of manufacturing a low-energy shock tube by co-extruding two or more layers simultaneously wherein the inner layer has an adhesive affinity for a powdered reactive material and the outer layer(s) provides abrasion, cut and other environmental resistance to the tube. The wall thickness of the inner layer is less than about 0.3 millimeters. The invention also relates to a low-energy shock tube having such configuration and inner layer thickness.

6 Claims, 1 Drawing Sheet

CO-EXTRUDED SHOCK TUBE

This application is a continuation of application Ser. No. 07/745,385, filed Aug. 15, 1991, now abandoned.

The present invention relates to a low-energy fuse or shock tube for propagating a percussion or impact wave within and along the tube for activation of a detonator. More particularly, the present invention relates to a multi-layer tube that is coextruded, wherein the innermost layer has adhesive affinity for a reactive material and a wall thickness of less than about 0.3 millimeter. The outer layer(s) has abrasion and cut resistance, and an optional outermost layer may be resistent to degradation from contact with either ultraviolet rays or liquid organics. By "co-extrusion" is meant forming the tube and its layers in a continuous, simultaneous operation through an extrusion element as is known in the art.

BACKGROUND OF THE INVENTION

Low-energy fuse or shock tubes are well known in the art. See, e.g., U.S. Pat. Nos. 3,590,739 and 4,328,753. Multi-layer shock tubes also are known from U.S. Pat. No. 4,328,753. In that patent the innermost layer of the tube was required to have adhesive affinity for a reactive substance which coats the inner surface of the innermost layer. The outermost layer had resistance to external damage. The inner layer was composed of SURLYN 1855 (registered trademark of DuPont), and the outer layer was a polyamide.

The tubes of the type described in U.S. Pat. No. 4,328,753 have been manufactured commercially for several years and contain either a single layer or an inner layer of SURLYN having a thickness generally of from about 0.8 millimeters or greater. U.S. Pat. No. 4,607,573 specifically discloses a multi-layered tube in which the inner tube is elongated or stretched before forming the outer tubular layer. The elongating or stretching is done to reduce the reactive material core load per unit length and the inner tube wall thickness. The inner tube is described as having an average inner diameter in the range of 0.017 to 0.070 inches and an outer diameter in the range of 0.034 to 0.180 inches. In other words, the wall thickness may range from 0.436 millimeter to 2.82 millimeters or more. Since SURLYN is a relatively expensive component of the tube, it is desirable and an object of the present invention to reduce the thickness of the innermost layer to less than about 0.3 millimeter in diameter. The outer layer(s) then can be formed with less expensive materials in thicker layers as desired for abrasion, cut and other resistance purposes.

Forming the multi-layer tube by co-extrusion enables the use of a much thinner inner layer than can be obtained by previous methods.

SUMMARY OF THE INVENTION

The invention comprises a method of manufacturing a low-energy shock tube comprising the steps of: (a) heating two or more materials to their respective desired extrusion temperatures; (b) co-extruding the materials to form a layered plastic tube having at least an inner layer with an inner surface and an outer layer, the inner surface of the inner layer having an adhesive affinity for a reactive material and the inner layer having a thickness of less than about 0.3 millimeter and the outer layer having abrasion and cut resistance; (c) feeding a reactive material to the inner surface of the inner layer as it is being co-extruded with the other layer or layers to form a thin layer of the reactive material on the inner surface; and (d) optionally cooling the co-extruded tubing to or below its solidification temperature and/or stretching the tube after it has been co-extruded to obtain the desired surface density of the reactive material, to increase the axial orientation of molecules of the plastic materials and thereby increase the tensile strength of the tube and to attain the desired inner layer thickness. The invention further comprises a shock tube whose inner layer has a wall thickness of less than about 0.3 millimeter.

DETAILED DESCRIPTION OF THE INVENTION

Figure 1:
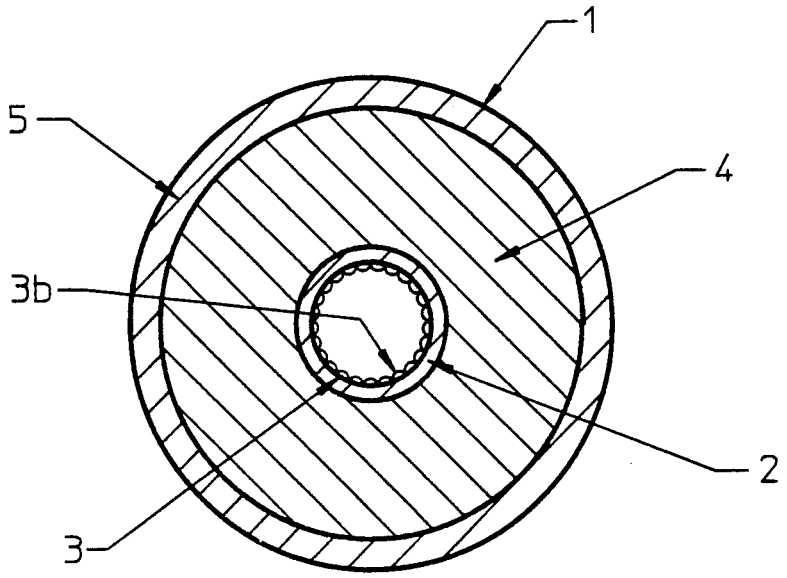
FIG. 1 is a transverse cross section of a preferred embodiment of a tube according to the present invention.

Reference to FIG. 1 shows a shock tube 1 in accordance with the present invention having an inner layer 2 with an inner surface 3 having an adhesive affinity for a reactive material 3*b*. The inner layer preferably has an adhesive property of at least 5.5 g/m$^2$ for the reactive material, which preferably is in powdered form. The inner layer 2 preferably is selected from the group consisting of SURLYN, ethylene/acrylic acid copolymers, ethylene vinyl acetate and other plastics and adhesives. In its final form, either as extruded or after stretching, the wall thickness of the inner layer 2 is less than about 0.3 millimeter.

An outer layer 4 is shown having a greater wall thickness than that of inner layer 2. This preferably provides for greater tensile strength and increased abrasion and cut resistance. The outer layer 4 preferably is selected from the group consisting of polyethylene, polyethylene blends with ionomer, polypropylene, polybutelyne, nylon and other polyolefins. This outer layer 4 preferably has a tensile strength of at least 35 MPa. An optional outermost layer 5 is shown that preferably provides protection from ultraviolet rays and/or chemicals such as organic liquids. A problem with shock tubes heretofore has been their susceptibility to degradation upon exposure to ultraviolet rays and/or organic liquids that are commonly found in blasting agents that the shock tube often contacts during application in the field. By reducing the wall thickness and thus the cost of the inner layer 2 and by co-extruding the layers, such optional outer layer 5 can be added without making the finished product overly expensive. The optional outermost layer 5 preferably selected from the group consisting of linear low, medium or high density polyethylene, polyester, polyvinylidene chloride and mixtures thereof.

The final surface density of the reactive material 3*b* on the inner surface of the inner layer can be varied as desired as known in the art. Typically, at least 2.7 g of reactive material per m$^2$ of the inner surface is desired. If the tube is stretched, the initial surface density before stretching may not be significantly changed after stretching, since the inner diameter may be reduced as the tube length is increased. The reactive material preferably is a powder mixture of such materials as PETN, RDX, HMX, powdered aluminum or other fuels and mixtures thereof.

Figure 2:
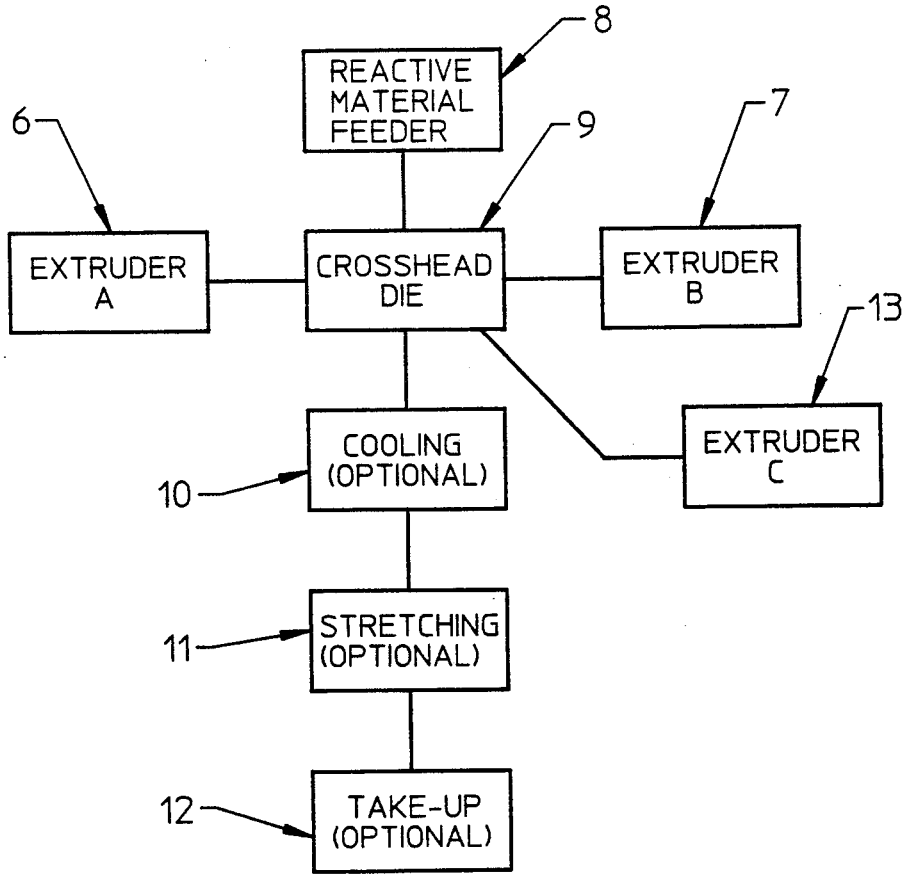
FIG. 2 is a flow diagram of the process steps involved in the method of the present invention.

Reference to FIG. 2 illustrates the method of the present invention. The inner layer material is extruded by an extruder 6 through the crosshead die 9. Simultaneously, the outer layer material is extruded by extruder 7 also through crosshead die 9. Crosshead die 9 is configured as known in the art so as to regulate the flow of the extruded materials and to position the material from extruder 6 internal and concentric to the material from extruder 7 thereby forming the two-layered tube configuration as the materials simultaneously exit from crosshead die 9. Optionally, a third, ultimate outer layer material can be fed to crosshead die 9 from extruder 13. Simultaneously with the feeding of the inner and outer layer materials from extruders 6 and 7, reactive material, preferably in powder form, is fed by reactive material feeder 8 through crosshead die 9 and to the inner surface of the inner layer to thereby coat the same.

The layer materials that are extruded through extruders 6 and 7 are pre-heated to their respective desired extrusion temperatures, and optionally, the two-layered tube exiting from crosshead die 9 is passed through a cooler 10, such as a water bath. Further optionally, the co-extruded tube may be stretched through stretcher 11 for purposes previously described. Stretcher 11 may comprise two pullers, one which takes tubing from the crosshead die 9 and then acts as a brake or anchor for a second puller which operates at a faster rate and thus stretches the tubing between the two pullers. Still further optionally, the tube may be wound on a take-up reel 12 by conventional means or otherwise gathered or collected as desired.

The invention can be further described by reference to the following examples.

EXAMPLE 1

A co-extruded tube was formed by heating SURLYN to a temperature of about 230° C. and extruding it by means of a 1-inch single screw extruder through a crosshead die while simultaneously heating linear low density polyethylene to a temperature of about 220° C. and extruding this material by means of a 1.5-inch single screw extruder through the same crosshead die. The SURLYN material formed the inner layer. The co-extruded tube that exited from the crosshead die had an outside diameter of 3.0 mm and an inside diameter of 1.1 mm. The SURLYN inner layer had a uniform wall thickness of 0.05 mm. The tube was cooled to a temperature of about 25° C. and then wound on a take-up reel.

EXAMPLE 2

A co-extruded tube was formed using the same extruders and inner and outer layer materials employed in Example 1 above. In this example, however, a differently sized crosshead die was used. The result was a two-layered tube having an outside diameter of 4.5 mm and an inside diameter of 2.1 mm. After cooling to a temperature of about 30° C., the tube was then stretched so that its outside diameter was reduced to 3.0 mm and its inside diameter was reduced to 1.2 mm. The final wall thickness of the SURLYN inner layer was 0.25 mm. This stretched tube had a much higher tensile strength than the tube produced in Example 1. The increased tensile strength was the result of orientation of the plastic molecules by the stretching process.

While the present invention has been described with reference to certain illustrative examples and preferred embodiments, various modifications will be apparent to those skilled in the art and any modifications are intended to be within the scope of the invention as set forth in the appended claims.

What is claimed is:

1. A method of reducing the thickness of the inner layer of a multi-layer low-energy shock tube comprising the steps of:

(a) heating at least two plastic materials to their respective, desired extrusion temperatures;

(b) extruding simultaneously by a co-extrusion process the plastic materials to form a layered plastic tube having at least an inner layer with an inner surface and an outer layer, the inner layer being extruded in a thickness of less than 0.3 millimeter and the inner surface of the inner layer having an adhesive affinity for a reactive material, and the outer layer having abrasion and cut resistance; and (c) feeding a reactive material to the inner surface of the inner layer as it is being co-extruded to form a thin layer of the reactive material on the inner surface.

2. A method according to claim 1 comprising the additional step of cooling the co-extruded tubing to or below its solidification temperature.

3. A method according to claim 1 comprising the additional step of stretching the tube to obtain the desired surface density of the reactive material, to increase the axial orientation of molecules of the plastic materials and thereby increase the tensile strength of the tube and to reduce further the inner layer thickness.

4. A method according to claim 2 comprising the additional step of stretching the tube after it has been co-extruded to obtain the desired surface density of the reactive material, to increase the axial orientation of molecules of the plastic materials and thereby increase the tensile strength of the tube and to reduce further the inner layer thickness.

5. A method according to claim 1 wherein a third, ultimate outer layer is co-extruded with the other layers.

6. A method according to claim 5, wherein the third layer has resistance to degradation from contact with ultraviolet rays or liquid organics.

* * * * *